US006772890B2

(12) United States Patent
Campbell et al.

(10) Patent No.: US 6,772,890 B2
(45) **Date of Patent: *Aug. 10, 2004**

(54) NARROW GROOVE DISPLAY PANEL

(75) Inventors: Rodney S. Campbell, Dover, OH (US); Randy Breyer, Dover, OH (US)

(73) Assignee: Commercial and Architectural Products, Inc., Dover, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/114,791

(22) Filed: Apr. 3, 2002

(65) Prior Publication Data

US 2003/0189019 A1 Oct. 9, 2003

(51) Int. Cl.[7] ..... A47F 5/08; A47B 57/34
(52) U.S. Cl. ..... 211/94.01; 211/59.1; 211/189
(58) Field of Search ..... 211/94.01, 59.1, 211/57.1, 189

(56) References Cited

U.S. PATENT DOCUMENTS

| | | | | | |
|---|---|---|---|---|---|
| 2,643,840 | A | | 6/1953 | Lanman | 211/162 |
| 3,235,218 | A | | 2/1966 | Graham | 248/223.41 |
| 3,502,222 | A | | 3/1970 | Crafoord | 211/40 |
| 4,572,381 | A | * | 2/1986 | Breakey et al. | 211/94.01 |
| 4,591,058 | A | | 5/1986 | Amstutz et al. | 211/94 |
| 4,607,753 | A | * | 8/1986 | Radek | 211/94.01 |
| 4,615,448 | A | | 10/1986 | Johnstonbaugh | 211/94 |
| 4,674,240 | A | * | 6/1987 | Strausheim | 211/189 |
| 4,817,900 | A | | 4/1989 | Whittington et al. | 248/225.1 |
| 4,844,266 | A | | 7/1989 | Small et al. | 211/88 |
| 4,944,416 | A | | 7/1990 | Petersen et al. | 211/87 |
| 5,018,323 | A | * | 5/1991 | Clausen | 211/87.01 |
| 5,109,993 | A | * | 5/1992 | Hutchison | 211/87.01 |
| 5,138,803 | A | * | 8/1992 | Grossen | 211/94.01 |
| 5,346,078 | A | * | 9/1994 | Ernetoft | 211/90.01 |
| 5,360,121 | A | | 11/1994 | Sothman | 211/87 |
| 5,375,802 | A | | 12/1994 | Branham, II | 248/231.4 |
| 5,390,462 | A | | 2/1995 | Kreiter | 52/506.05 |
| 5,484,067 | A | | 1/1996 | Sothman | 211/87 |
| 5,711,115 | A | * | 1/1998 | Wirt | 52/36.3 |
| D414,567 | S | | 9/1999 | Burt et al. | D25/123 |
| 6,065,262 | A | | 5/2000 | Motta | 52/582.1 |
| 6,199,705 | B1 | * | 3/2001 | Portner | 211/94.01 |
| D444,577 | S | | 7/2001 | Neuhofer, Jr. | D25/138 |
| 6,491,172 | B2 | * | 12/2002 | Chance et al. | 211/87.01 |
| 6,547,086 | B1 | * | 4/2003 | Harvey | 211/87.01 |
| D477,423 | S | * | 7/2003 | Campbell et al. | D25/138 |
| D482,552 | S | * | 11/2003 | Campbell et al. | D6/509 |
| D486,676 | S | * | 2/2004 | Campbell et al. | D6/491 |

* cited by examiner

*Primary Examiner*—Daniel P. Stodola
*Assistant Examiner*—Erica B. Harris
(74) *Attorney, Agent, or Firm*—Pearne & Gordon LLP

(57) ABSTRACT

A display panel includes a plurality of horizontal grooves that each have a throat open to the panel face and extend to an inner cavity for receiving an s-shaped hanger end portion of a bracket adapted to support articles. The groove has a compact cross-sectional shape including reduced opening and inner cavity widths and increased panel wall and throat wall thicknesses at the opening. The throat wall may be inclined to transfer compressive load forces from the panel wall engaged by the upper extremity of the hanger end portion. The inner cavity may have a bulbous shape and be provided with a reinforcing liner. Compact hanger end portions include central portions of increased length, and optionally inclined, to be fully supported along the throat wall. The compact hanger end portions may be provided by reshaping standardized bracket hardware.

46 Claims, 7 Drawing Sheets

NARROW GROOVE DISPLAY PANEL

BACKGROUND OF INVENTION AND RELATED ART

The present invention relates to support boards or panels, and more particularly, relates to display or wall panels having grooves or slots for mounting hanger end or base portions of cantilever supported brackets used to display articles.

Many types of display panels have been developed in the past. Some panels include grooves having J-shaped or L-shaped cross-sections and therefore require a specific mounting orientation. As a result, a modified T-shaped slot or groove was developed with the advantage that the panel may be mounted either edge up. The T-shaped groove includes a throat having a throat opening in the front of the panel and extending a depth into the panel to join an inner cavity. The throat is formed by adjacent upper and lower panel wall portions.

Examples of such display wall panels are illustrated and described in U.S. Pat. Nos. 3,235,218, 3,502,222, 4,591,058, 4,817,900, 4,844,266, 4,944,416, 5,360,121 and 5,484,067. The panels are frequently formed of composite materials such as hardboard, fiberboard, flake board, chipboard, plywood and the like, as well as, plastic or metal. Display panels used in retail sales are often formed of medium density fiberboard and the grooves are cut or machined into the material forming the panel. Decorative finishes and laminates may be applied to the panels. In some cases, reinforcing inserts are installed in the grooves to increase the panel strength and enable support of heavier loads on the brackets as shown in U.S. Pat. No. 4,615,448. The inserts may be formed of metallic or plastic materials.

There has been a tendency to standardize the display panels so that a given bracket may be utilized with substantially any of the available grooved display panels. Further, the dimensions of the T-shaped grooves have been selected to permit the use of commonly available brackets initially intended for use with pegboard.

The hanger end portion of the bracket also tended to be standardized. It has an S-shape including parallel upper and lower vertical arm portions joined by a perpendicular central or connecting arm portion. The connecting arm portion of the hanger rests on a lower panel wall portion forming the throat, the upper arm extends into the cavity to engage the inner surface of the upper panel wall portion and the lower arm engages the lower panel wall portion and face of the panel. In use, the load tends to pivot the hanger end portion about the throat opening.

It is desirable to increase the panel strength and, more particularly, the maximum panel hang weight strength as defined hereinafter. Panel failure is due to fracture or rupture of panel portions adjacent the hanger mounting site with portions of the panel being separated from the panel face as the hanger end portion of the bracket is pulled from its mounted or groove engaging position.

It is also desirable to avoid replacement of standardized bracket hardware since most panel users have a large inventory of hardware. Accordingly, it is preferable that any strength modification of the panel enable the continued use of existing bracket hardware.

SUMMARY OF THE INVENTION

It has now been found that panel strength, and especially resistance to bracket pull-out due to hang load, may be particularly enhanced by a modified groove cross-section characterized by a reduced opening width and increased panel wall thickness at the opening. Such a cross-sectional configuration tends to increase the amount of panel material available at the immediate bracket support location about which the hang load tends to pivot the hanger end portion of the bracket.

In accordance with the invention, the groove is shaped with a modified compact profile to provide increased panel hang strength while maintaining easy and stable mounting of the brackets. The hanger end portions of the brackets are also shaped with a compact profile to facilitate the insertion and removal thereof from the groove while achieving reliable and stable mounting of the bracket.

The compact groove profile includes a reduced inner cavity dimension sufficient to allow pivoting or other angular movement of the hanger end portion during insertion and removal. To that end, a bulbous cross-sectional shape may be used.

As measured parallel to the face of the panel, the bulbous cross-sectional shape has a reduced width dimension as compared with the prior art T-shaped grooves or slots. In addition, the bulbous cross-sectional shape is characterized by a width-to-depth aspect ratio substantially less than that of the prior art T-shaped grooves or slots. The bulbous cross-sectional shape has an arcuate wall to facilitate mounting of the hanger end portion and at least one wall provided by the panel portion forming the upper throat wall against which the hanger end portion is biased to resist pivotal movement as it supports the bracket.

The groove may be configured to cooperate with the hanger end portion to transfer and more evenly distribute the hang load between the walls of the panel forming the throat opening. For example, if the lower throat wall supporting the connecting arm portion of the hanger end portion is sloped downwardly into the groove, the bracket load applied to the upper throat wall or the compressive forces resisting pull out in the upper wall are in-part transferred to or provided by the lower wall.

The inclined throat wall is contained in a plane that forms an included acute angle with the plane of the front face of the panel. The included acute angle will typically be greater than 77.5 degrees, for example, 82 to 88 degrees and more preferably about 85 degrees. Since non-inclined throat walls contained in a plane perpendicular to the front face plane are also contemplated, the included angle between the front face plane and throat wall plane may range from about 77.5 to 90 degrees.

The compact groove and hanger end portion enable reliable support of increased hang loads with little, if any, increase in panel cost. In fact, the compact profile requires less shaping of the panel material and thereby reduces the manufacturing costs. That is, the amount of panel material removed to form the groove is reduced so as to correspondingly reduce energy costs and lessen waste disposal.

In addition, the compact hanger end portion may be formed by reshaping existing hardware using relatively simple reshaping and shearing processes. It is not necessary to purchase new bracket hardware, and the standardized bracket hardware may be reshaped to the compact size contemplated in accordance with the invention.

DETAILED DESCRIPTION OF THE DRAWINGS

Figure 1:
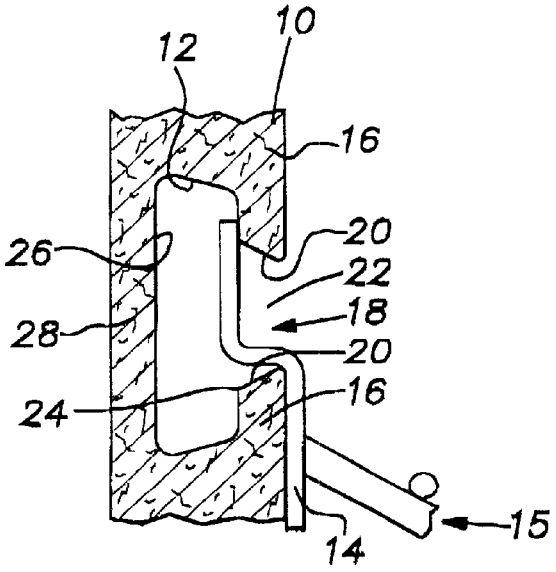
FIG. 1 PRIOR ART
FIG. 1 is a fragmentary cross-sectional view of a prior art T-shaped groove having a hanger end portion of a bracket mounted therein.

Referring to FIG. 1, a prior art panel 10 includes a T-shaped groove or slot 12 having a standardized hanger end portion 14 of a bracket 15 mounted therein. The bracket 15 may include a shelf or a bar for supporting articles to be displayed. The panel 10 includes front and back parallel faces, and it has a ¾" thick nominal thickness.

The groove 12 includes upper and lower groove overhang portions 16 that form a throat 18. As shown, the throat 18 includes opposed throat walls 20 extending from a throat opening 22 in the face of the panel 10 to a throat inner end 24. The throat 18 joins an elongated vertically extending opening or inner cavity 26 at the throat inner end 24.

The throat opening 22, as measured in the vertical direction, has a ⅜" or 0.375" nominal thickness. The overhang portions 16 have a depth or thickness equal to 0.250". The throat walls 20 diverge upwardly and downwardly from the horizontal at about 30 degree angles to form a 60 degree enclosed angle. The cavity 26 has a depth equal to about 0.250" and a width measured in the vertical direction equal to 1.25". A groove base portion 28 has a depth or thickness of about 0.50".

The hanger end portion 14 is typically formed of steel having a thickness in the range of 0.070" to 0.125". The central or connecting portion of the hanger end portion 14 is sized to correspond with the depth or thickness of the overhang portion 16 and is about 0.25" long.

As shown a FIG. 1, the hanger end portion 14 is in line contact with the lower throat wall 20 in the plane of the throat opening 22. That is, the lower surface of the connecting portion of the hanger end portion 14 only engages the surface of the throat wall 20 along a narrow contact line in the opening 22 so as to restrict or prohibit transfer of bracket load or compressive resisting forces from the upper overhang portion 16 to the lower overhang portion 16. Also, such contact tends to maximize the downward load per unit area.

Figure 2:
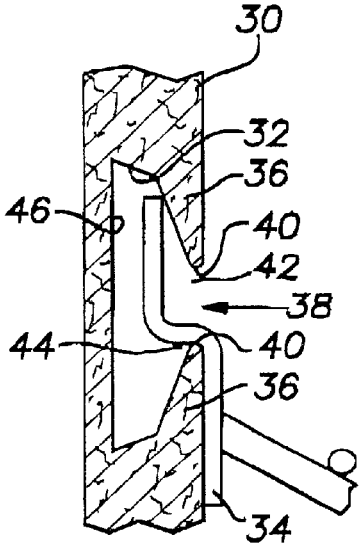
FIG. 2 PRIOR ART
FIG. 2 is a fragmentary cross-sectional view similar to FIG. 1 showing a prior art modified T-shaped groove having a hanger end portion mounted therein.

Referring to FIG. 2, a prior art panel 30 includes a modified T-shaped groove or slot 32 having a standardized hanger end portion 34 of a bracket mounted therein. The hanger end portions 14 and 34 are identical. The panel 30 may be have a ½" nominal thickness.

The groove 32 is formed by upper and lower groove overhang portions 36 forming a throat 38. The throat 38 has opposed walls 40 formed by the arcuate edges of the overhang portions. A throat opening 42 is formed in the face of the panel 30 and a throat inner end 44 joins a vertically extending elongated opening or inner cavity 46.

The throat opening 42 has a width measured in the vertical direction equal to about 11/32". The thickness or depth of the groove overhang portion 36 varies from that of the radiused edges at the throat 38 to about 0.25" at the upper and lower extremities thereof. As shown, the hanger end 34 is supported at the throat 38 formed by the radiused edges of the overhang portions 36. The cavity 46 has a depth equal to about 0.250" and a width measured in the vertical direction equal to 1.25".

As shown in FIG. 2, the hanger end portion 34 provides line contact with the lower throat wall 40 substantially in the plane of the throat opening 42. Thus, the prior art groove 32 and hanger end portion 34 also fail to transfer loads and/or compressive resisting forces between the overhang portions 36 and the downward load per unit area is substantially maximized.

Figure 3:
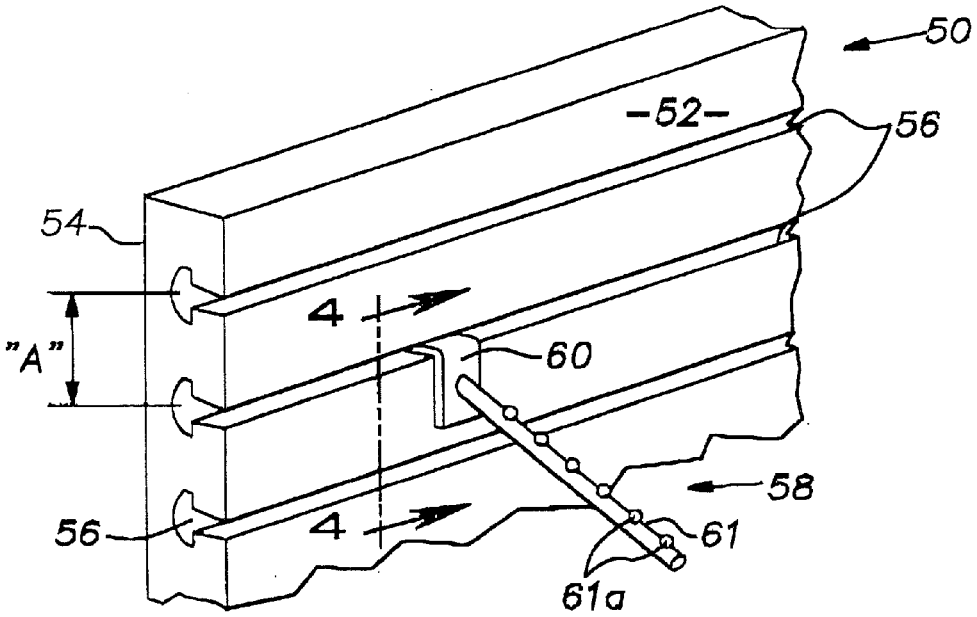
FIG. 3 is a fragmentary perspective view of a display panel having a plurality of grooves according to the invention and having a bracket supported in one of the grooves.
Figure 4:
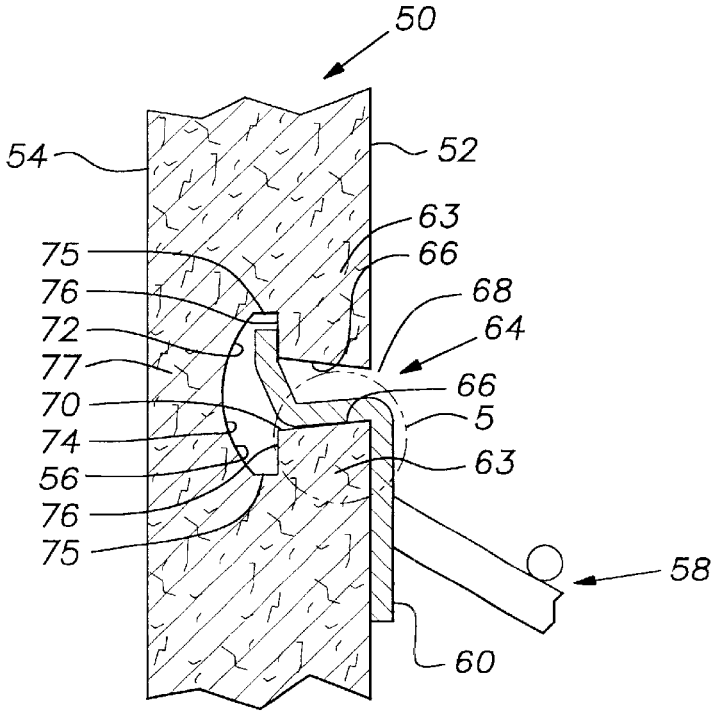
FIG. 4 is a fragmentary cross-sectional view, on an enlarged-scale, taken along the line 4—4 in FIG. 3.

Referring to FIG. 3, a portion of a display panel 50 in accordance with the present invention is shown. The panel 50 is supported in a vertical position by any suitable means (not shown) and, for example, it may be fixed to a structural wall or comprise part of a self-standing floor or counter-top display. Accordingly, the panel 50 may be 5×10', 4×10', 4'×8', 4'×4', or some other conventional size commonly used. As indicated above, the panel 50 is formed of a medium density fiberboard. However, the panel 50 may be formed of any suitable composite material such as hardboard, fiberboard, flake board, chip board, plywood and the like, as well as plastic or metal.

The panel has a planar front face 52, a planar opposed and parallel rear face 54, and a ¾" nominal thickness, for example. A plurality of modified T-shaped horizontally extending grooves or slots 56 are open to the front face 52. Typically, there are a plurality of such grooves formed in the panel at vertically spaced locations. For example, the grooves 56 are disposed at a center to center spacing "A" equal to 3". The spacing "A" may range from about 1.5" or greater. As will become more apparent hereinafter, the reduced dimensions of the grooves 56 enable closer spacing without excess of reductions in the panel hang weight strength.

The center to center spacing "A" of the grooves 56 enables the mounting of a plurality of brackets, such as bracket 58, for supporting articles to be displayed. The bracket 58 may be installed on the panel at substantially any desired location. The bracket 58 is a cantilever-type bracket including an S-shaped base or hanger end portion 60 engaging the panel 50, as described more fully below, and a cantilever portion 61 projecting downwardly at a 60 degree angle from the front face 52 of the panel 50. The portion 61 includes a plurality of stops 61*a* for engaging display hangers or the like. The portion 61 may comprise a perpendicularly extending shelf or arm, or any other conventional bracket for supporting articles.

Referring to FIGS. 3–6, the shape of the groove 56 and the support of the bracket 58 are illustrated in further detail. Each of the grooves 56 includes groove overhang portions 63 that form a throat 64. The throat 64 includes opposed throat walls 66 extending from a throat opening 68 in the face of the panel 50 to a throat inner end 70. The throat 64 joins an inner cavity or socket 72 at the throat inner end 70.

The socket 72 has a bulbous shape configured to accept the hanger end portion 60. The socket 72 is bounded by an arcuate rear or back wall 74 connecting upper and lower sidewalls 75 extending to opposed flat front or inner walls 76. In the illustrated embodiment, the rear wall 74 has a semicircular cross-section, the sidewalls 75 are slightly bowed outwardly and the front or inner walls 78 are substantially planar and extend diametrically toward the throat walls 66. The arcuate configuration of the socket walls and radius transitions avoid stress locations.

Since the groove 56 will typically be shaped by a router cutting or milling process, the groove will have a cross-section that is symmetrical about one axis. For example, the cross-section of the groove 56 is symmetrical about an axis perpendicular to the front face of the panel and extending along the center of the throat.

The throat opening 68 has a width measured in the vertical direction equal to 0.175". The throat opening or width is smaller than prior art ⅜ inch width, and may range in size from less than about ¼ inch to about ⅛ inch or less, as shown by the 0.175" size of the throat opening 68.

The throat depth corresponds with the distance from the throat opening 68 to the inner end 70, and it will typically be equal to the thickness or depth of the groove overhang portion. In the illustrated embodiment, the groove overhang portions 63 have a depth or thickness equal to 0.3125". For purposes of improved hang weight strength, the throat depth or overhang thickness may be equal to about 0.3" or more. The overhang portions 63 terminate at beveled ends forming inclined throat walls 66. The throat walls 66 diverge upwardly and downwardly at about 5 degree angles to form a 10 degree enclosed angle.

The socket 72 has a bulbous shape configured to accept the hanger end portion 60. The socket 72 is bounded by an arcuate rear or back wall 74 connecting upper and lower sidewalls 75 extending to opposed flat front or inner walls 76. In the illustrated embodiment, the rear wall 74 has a semicircular cross-section, the sidewalls 75 are slightly bowed outwardly and the front or inner walls 76 are substantially planar and extend diametrically toward the throat walls 66. The arcuate configuration of the socket walls and radius transitions avoid stress locations.

The groove 56 includes a groove base portion 77 between the rear wall 74 and the back face 54. The groove base portion 77 has a depth or thickness equal to 0.25".

Figure 5:
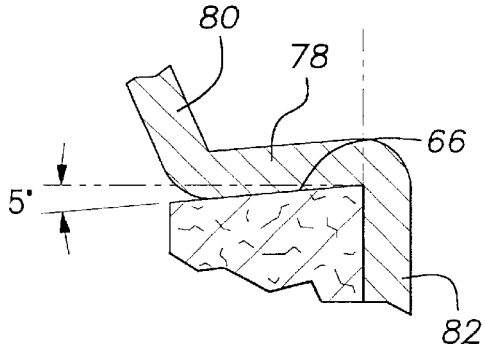
FIG. 5 is a sectional view, on an enlarged scale, taken along the dotted line 5 in FIG. 4.

The hanger end portion 60 includes a central or connecting portion 78 extending between an upper arm portion 80 and a lower arm portion 82. The central portion 78 is inclined at about a 5 degree angle to match the slope of the lower throat wall 66 and to provide it with a corresponding profile as best seen in FIG. 5. In this manner, the central portion 78 is fully supported along the length of the throat wall 66. That is, a major extent of the central portion 78 is in close surface contact with the throat wall 66. Such engagement also distributes the load over substantially all of the surface of the wall to reduce the force per unit area.

In the installed or mounted position as shown, the central portion 78 rests upon the lower throat wall 66 and provides the vertical support for the bracket. The upper arm portion 80 extends upwardly and engages the wall 76. The lower arm portion 82 engages the front face 52 of the panel 50. The force moment applied to the panel by articles supported on the cantilever portion of the bracket 58 tends to pivot the hanger end portion 60 about the throat wall 66 and out of the groove 56 so as to cause the panel to fail with bracket pullout. Thus, loads are applied to the upper wall 76 by the upper arm portion 80 and to the throat wall 66 by the central portion 78. These loads are resisted by compressive forces in the upper overhang portion 63 at the wall 76 and in the lower overhang portion 63 at the throat wall 66. The resisting compressive forces are applied in the same direction at the walls 76 and 66 and together with the compressive force applied by the front face 52 to the lower arm portion 82 provide a force couple which resists the bracket force moment. In this manner, the applied loads and the resisting compressive forces are distributed between the walls 76 and 66 and/or the upper and lower overhang portions 63 and the maximum hang weight of the panel is increased.

As shown, the groove 56 has a compact configuration wherein the vertical dimension of the socket 72 is sized to provide a minimal clearance for the end of the upper arm portion 80 when in the mounted position. In a like manner, the arcuate rear wall 74 provides a maximum depth at the center of its width to accommodate the generally horizontal direction of insertion and maximum penetration of the upper arm portion 80 during mounting. Similarly, the decreasing depth of the socket 72 adjacent the extremities of its width corresponds with the reduction in penetration in the horizontal direction as the upper arm portion 80 is rotated or pivoted to its generally vertical mounted position against the wall 76. Accordingly, the bulbous shape of the groove 56 provides the required clearances for the hanger end portion and facilitates its installation with a reduced cavity volume and loss of panel strength due to removal of material forming the panel.

One measure of the relative compactness of the groove 56 is its width to depth aspect ratio. The aspect ratio of the groove 56 is about 1.0 (0.545"/0.5"). In contrast, the prior art grooves 12 (FIG. 1) and 32 (FIG. 2) each have an aspect ratio equal to 2.5 (1.25"/0.5") or greater.

It should be appreciated that the aspect ratio values may be reduced by about ½ when considered in terms of only the upper half of a T-shaped groove which is actually used in connection with the mounting of the bracket, the lower half of the groove being provided to permit mounting of the panel without regard to top and bottom panel orientation. This is true for non-symmetrical grooves such as L-shaped groove.

In accordance with the invention, the aspect ratio of the groove may vary from about 1 to about 1.75 for symmetrical groups such as the T-shaped groove 56. With particular regard to the panel 50, the compact groove 56 requires the removal of less panel material as it is formed by saw and router shaping techniques so as to result in less particle waste and a more environmentally favorable groove and panel configuration.

Of course, the hanger end portion of the bracket hardware must be similarly compact to maintain easy and stable mounting within the groove as described more fully below. In addition, the reduced dimensions of the hanger end portion 60, and in particular the upper arm portion 80, tend to minimize flexing and provide more uniform bracket mounting and article support. The increased stiffness also enhances the transfer of forces to the inclined lower throat wall 66.

As compared with the prior art systems shown in FIGS. 1 and 2, the compact groove 56 and hanger end portion 60 provide increased resistance to accidental disengagement as a result of a temporary and/or accidental upward force applied to the bracket 58. In response to such upward forces, prior art hanger end portions have a tendency to disengage from the groove. The relatively larger throat opening and shorter throat depth of the prior art grooves permits a counterclockwise pivotal movement (as shown in FIGS. 1 and 2) of the bracket in response to an upward force. Such pivotal movement tends to be sufficient to disengage the central or offset portion of the bracket from its supported position on the throat wall and permit the upper portion of the bracket to slip from the groove in a downward direction. In comparison, the relatively smaller throat opening, e.g. about 0.175", and/or the relatively larger throat depth, e.g., 0.3" or more, in accordance with the invention tends to resist accidental disengagement due to the pivotal movement resulting from a temporary upward force applied to the bracket.

Figure 6:
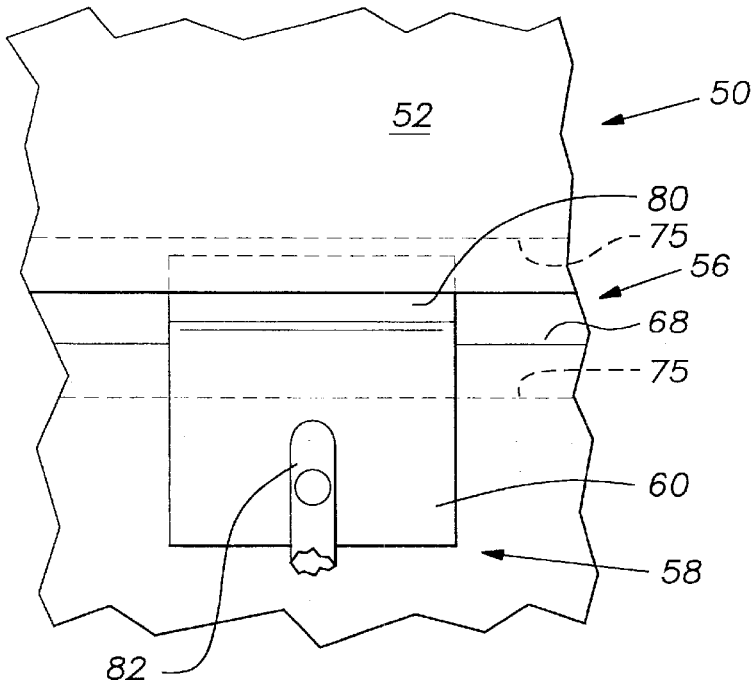
FIG. 6 is a fragmentary elevational view, on an enlarged scale, showing the details of the groove opening and mounted hanger end portion as viewed from the front of the panel.

Referring to FIG. 6, the appearance of the bracket 58 as mounted in the groove 56 is shown as viewed from the front face 52 of the panel. As illustrated, the lower arm portion 82 of the bracket 58 extends along the face 52 of the panel and extends over about 40 to 50 percent on the throat opening 68. Accordingly, the upper arm portion 80 is only visible through the remaining 50 to 60 percent of the width of the throat opening 68 which is equal to a viewing width of about ⅛" in the illustrated embodiment. This limited view tends to obscure the upper arm portion 80 which has been found desirable in retail sale product display applications from an aesthetic standpoint. Similarly, the reduced width of the throat opening 68 has been found to be aesthetically more pleasing in such commercial applications.

Figure 7:
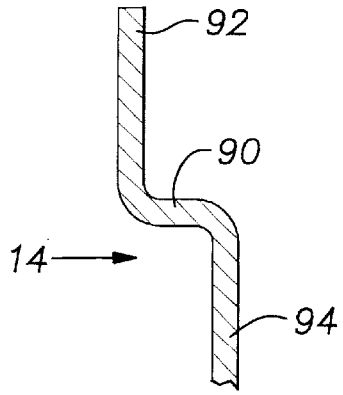
FIG. 7 PRIOR ART
FIG. 7 is a fragmentary elevational view showing the hanger end portion of the bracket in FIG. 1 in accordance with the prior art.

FIG. 7 shows the prior art hanger end portion 14 of the bracket 15 of FIG. 1. The hanger end portion 14 includes a central or connecting portion 90 laterally extending between an upper arm portion 92 and a lower arm portion 94. The upper and lower arm portions 92 and 94 are disposed in substantially parallel relationship and the offset portion 90 extends at a right angle between the arm portions.

The hanger end portion 14 is a so-called "standardized" bracket in accordance with the prior art. Accordingly, its arm portions are substantially parallel and connected by a perpendicular central portion. The upper arm portion 92 has a length equal to about from about ⅜" to about ½" to provide engagement with the interior wall surface of the groove 12. The central portion 90 has a length equal to about 0.25". The lower arm portion 94 may be provided with any convenient length. The hanger end portion 14 may be formed of a steel strip material having a thickness of about 0.070" to 0.125" and a width of about ½" or greater.

Figure 8:
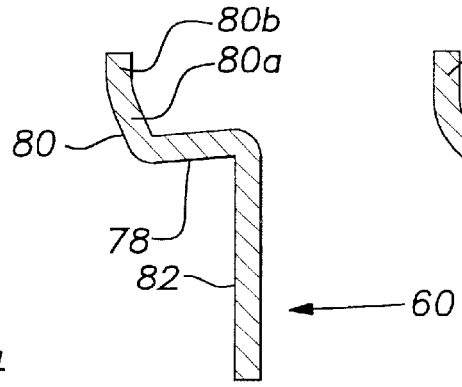
FIG. 8 is a fragmentary elevational view similar to FIG. 7 showing the hanger end portion of the bracket in FIG. 3 in accordance with the present invention.

Referring to FIG. 8, the hanger end portion 60 in accordance with the embodiment of FIG. 3 is shown. As described above, the hanger end portion 60 includes central portion 78 connecting upper arm portion 80 and lower arm portion 82. The upper arm portion 80 includes an angular portion 80*a* extending to a terminal portion 80*b* having a generally vertical surface adapted to engage the surface of the wall 76 of the groove 56. The upper arm portion 80 extends in a vertical direction about 0.250" to about 0.350" in order to assure secure engagement with the wall 76. The central portion 78 has a length equal to from about 0.250" to about 0.300". The lower arm portion 82 may be provided with any suitable length.

The hanger end portion 60 may be formed of the same metal strip material as the hanger end portion 14. As described more fully below, a standardized hanger end portion 14 may be reshaped using simple press reshaping and shearing processes to provide it with a shape corresponding with that of the hanger end portion 60 so that it may be used in the groove 56 or a similar compact groove design in accordance with the invention.

Figure 9:
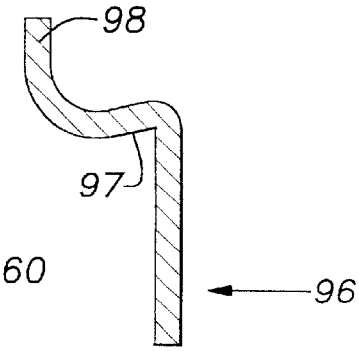
FIG. 9 is a fragmentary elevational view similar to FIG. 7 showing a modified hanger end portion in accordance with another embodiment of the present invention.

FIG. 9 illustrates a hanger end portion 96 in accordance with a further embodiment of the present invention. The hanger end portion 96 is similar to the hanger end portion 60, and includes a central portion 97 extending to a smoothly curved upper arm portion 98.

It should be appreciated that the central portions 78 and 97 each extend at a 5 degree slope and that the upper arm portions 80 and 98 are inclined from the vertical. The inclined central portions 78 and 97 provide hanger profiles corresponding with that of the surface of the throat wall to provide transfer of load and resisting compressive forces. The inclined vertical orientation enhances transfer of the load and compressive resistance forces from the upper overhang portion to the lower overhang portion in the above described embodiments.

As indicated above, standardized hardware brackets, such as the bracket 15, maybe reshaped for use in connection with the invention. To that end, the hanger end portion 14 shown in FIG. 7 may be reshaped and sheared in a press process to conform with the hanger end portion 96 as shown in FIG. 9.

Figure 10:
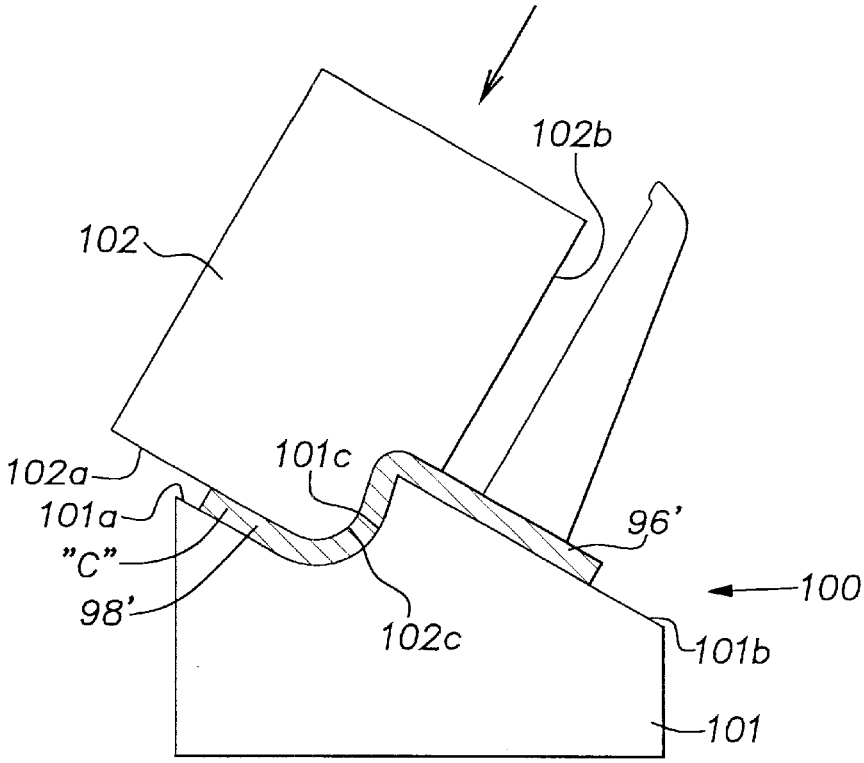
FIG. 10 is a fragmentary schematic view showing the pressing of standardized hardware to reshape it for use in accordance with the invention.

Referring to FIG. 10, a press 100 for reshaping the hanger end portion 14 is shown affixed to a straight shelf bracket. The press 100 includes a stationary bed 101 and a closable press plate 102 having mating working surfaces shaped to conform with the profile of a compact hanger end portion such as the hanger end portion 96. Accordingly, the bed 101 includes a working surface having upper and lower arm forming portions 101*a* and 101*b* connected by a central portion 101*c* extending at an angle conforming with that of the throat wall incline. The press plate 102 includes a mating working surface having portions 102*a*, 102*b* and 102*c*.

As illustrated in FIG. 10, the press 100 is closed and has completed the reshaping of the prior art hanger end portion of the shelf bracket to provide an intermediate hanger end portion 96'. The portion 96' has an angular configuration or profile identical with that of the portion 96, but an elongated upper arm portion 98' is to be cut off adjacent its end. For example, the upper arm portion 98' may be cut at line "C". The resulting reshaped hanger end portion is substantially identical with the hanger end portion 96.

Figure 11:
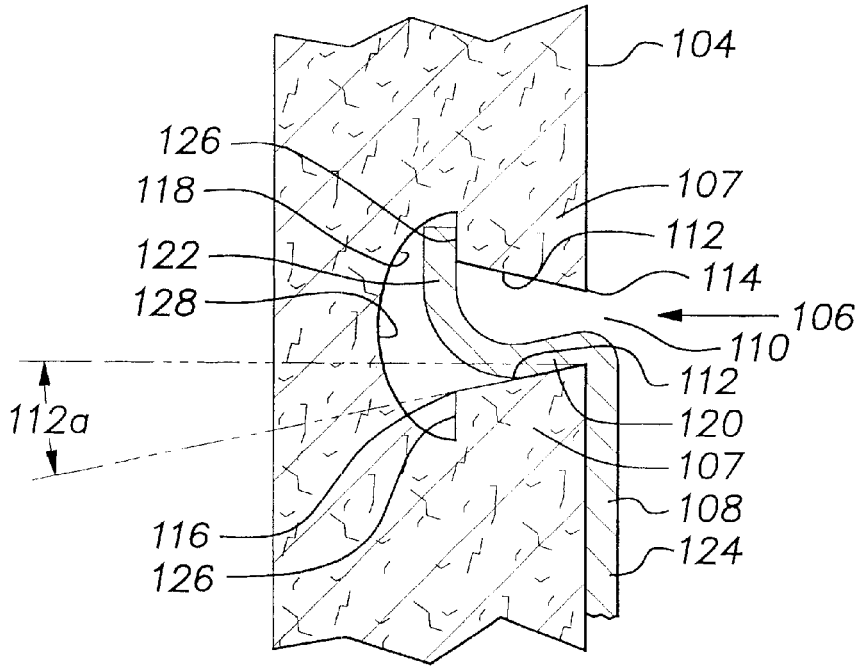
FIG. 11 is a fragmentary cross-sectional view showing a modified groove having a hanger end portion mounted therein in accordance with another embodiment of the invention.

Referring to FIG. 11 and, a display panel 104 having a groove 106 and a hanger end portion 108 mounted therein are shown in accordance with another embodiment of the invention. The display panel 104 is similar to the display panel 50 in that it also is adapted for mounting in a vertical orientation and a plurality of horizontally extending grooves 106 are provided for mounting the hanger end portions 108 of brackets for supporting or displaying articles.

The groove 106 includes groove overhanging portions 107 that form a throat 110. The throat 110 includes opposed throat walls 112 extending from a throat opening 114 in the face of the panel 104 to a throat inner end 116. The throat 110 joins an inner cavity or socket 118 at the throat inner end 116.

The throat walls 112 diverge upwardly and downwardly at about 12.5 degree angles, as indicated at 112*a*, to form an enclosed angle of about 25 degrees. In order to assure engagement with the sloped throat wall, the hanger end portion 108 has a central portion 120 that extends at a similar 12.5 degree downward slope between upper arm portion 122 and lower arm portion 124.

The increased slope of the throat walls 112 tends to more securely lock the hanger end portion 108 in its mounted position within the groove 106. Further increases in the slope of the throat walls are limited by the need to maintain an adequately sized flat front or inner wall 126 for engagement with the upper arm portion 122 of the hanger end portion 108 and a compact socket size.

The increased slope of the throat wall 112 also cooperates with the rearward incline of the upper arm portion 122 to transfer an increased portion of the bracket load and resistive compressive forces from the upper overhanging portion 107 to the lower overhang portion 107. In this manner, the loads and resisting forces are more evenly distributed between the upper and lower overhang portions 107, and the hang weight prior to failure, is increased.

In this embodiment, the socket 118 has a rear wall 128 having a semicircular cross-section that directly connects the front walls 126 so as to eliminate separate sidewalls as in the embodiment of FIG. 3. The groove 106 otherwise has dimensions similar to those of the groove 56. That is, the dimensions of the throat opening and depth are the same as those of the groove 56 and the socket 118 has the same width and depth dimensions as the socket 72. Also, the included acute angle of the throat wall with the panel front face may range from 77.5 to 90 degrees in the same manner as in the embodiment of FIG. 3.

Figure 12:
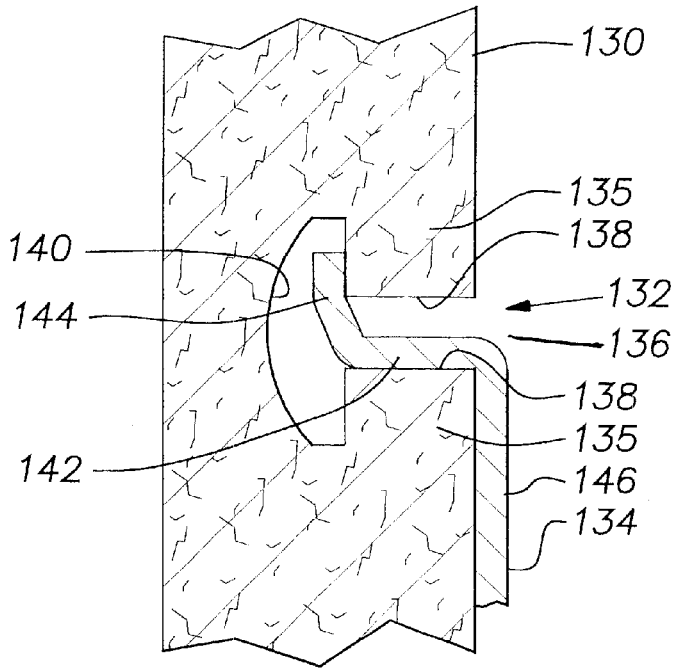
FIG. 12 is a fragmentary cross-sectional view similar to FIG. 11 of a modified groove and mounted hanger end portion in accordance with a further embodiment of the invention.

Referring to FIG. 12, a display panel 130 having a groove 132 and a hanger end portion 134 mounted therein are shown in accordance with another embodiment of the invention. The display panel 130 is similar to the display panels 50 and 104.

The groove 132 includes upper and lower groove overhang portions 135 forming a throat 136. The throat 136 is bounded by opposed throat walls 138 extending from a throat opening in the face of the panel 130 to a throat inner end where it joins an inner cavity or socket 140.

The throat walls 138 are substantially parallel to each other and extend in planes that are perpendicular to, or at a 90 degree slope with respect to, the plane of the front face of the panel 130. The hanger end portion 134 is similarly configured in that central portion 142 extends in a substantially perpendicular direction between upper arm portion 144 and lower arm portion 146. The groove 132 includes a socket shape similar to the socket 72 in the embodiment of FIG. 3.

Although the throat walls 138 are not inclined, the display panel 130 continues to enjoy the benefits of the compact shape of the groove 132 and a relatively increased thickness of the overhang portions 135. In a like manner, this panel also has an increased hang weight as compared with the prior art T-shaped grooves.

Figure 13:
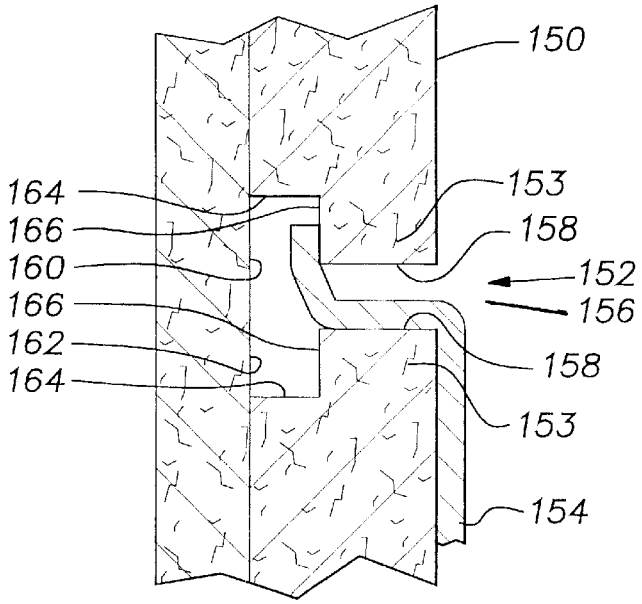
FIG. 13 is a fragmentary cross-sectional view similar to FIG. 12 of a modified groove and mounted hanger end portion in accordance with yet a further embodiment of the invention.

Referring to FIG. 13, a display panel 150 includes a groove 152 having a hanger end portion 154 mounted therein. The groove 152 includes upper and lower overhanging portions 153 that form a throat 156 having parallel throat walls 158 connected to an inner cavity or socket 160.

The socket 160 has a rectangular cross-section. The socket 160 is defined by flat or planar walls including a rear wall 162 connecting top and bottom walls 164. The top and bottom walls 164 extend to front or inner walls 166 which are connected to the throat walls 158. The throat walls 158 are also flat and they are contained in planes forming a 90 degree angle with the plane of the front face of the panel. However, the throat walls 158 may be inclined in the same manner as described in the embodiment of FIG. 3.

Figure 14:
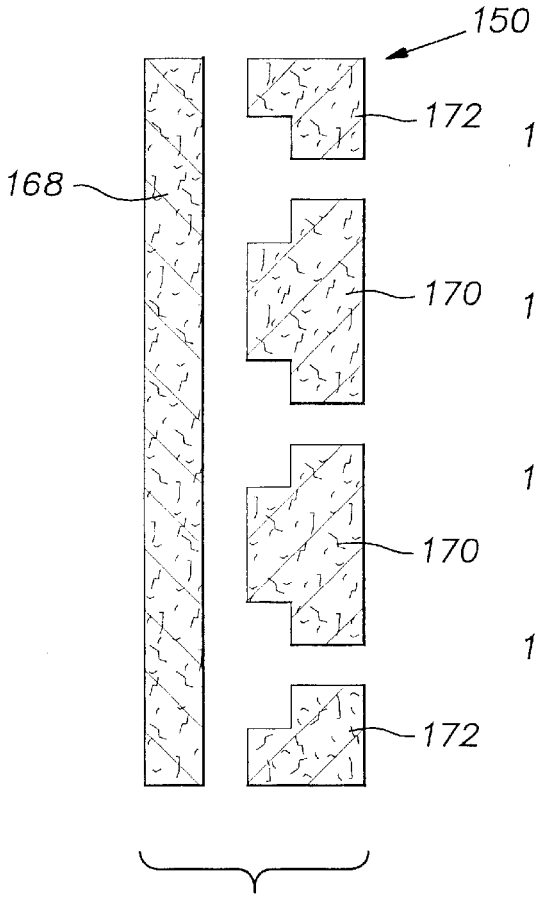
FIG. 14 is an exploded elevational view, on a reduced scale, showing panel components that are assembled to provide a display panel having grooves in accordance with the embodiment of FIG. 13.

Referring to FIG. 14, the components forming the display panel 150 are shown in an exploded the view. The components include a rear panel 168, T-shaped slats 170 and L-shaped slats 172. The components may be formed of the same fiberboard materials as described above. All of the components may be formed using saw cutting techniques, and assembled with conventional fasteners and/or adhesives. Upon assembly, adjacent pairs of slats 170, or 170 and 172, cooperate to define grooves 152.

It is also possible to form the display panel 150 from a single monolithic board using reshaping techniques as described above. That is, sawing followed by routering, but with a square cutter.

Figure 15:
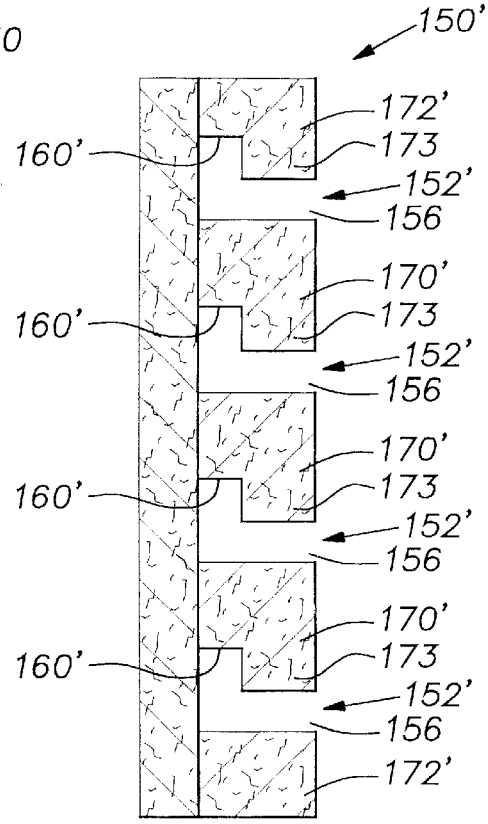
FIG. 15 is a schematic cross-sectional view showing modified panel components, similar to those of FIG. 14, assembled to form grooves similar to the embodiment of FIG. 13, but having an L-shape cross-section.

Referring to FIG. 15, a modified display panel having a construction similar to that of the panel 150 is shown. For convenience, identical parts are similarly numbered and modified parts are indicated with the same number and a prime designation.

As shown in FIG. 15, a display panel 150' includes grooves 152' having L-shape cross-sections. The slats 170' and 172' are provided with a rectangular shape or an L-shape so that adjacent slats form L-shape grooves 152'. Each of the L-shaped slats 170' and 172' includes an overhang portion 173 that cooperates with an adjacent slat wall to define a throat 156 of the groove 152'. The grooves 152' have dimensions similar to those of the grooves 152 except that the width of the socket 160' is equal to about one-half of that of the socket 160.

Figure 16:
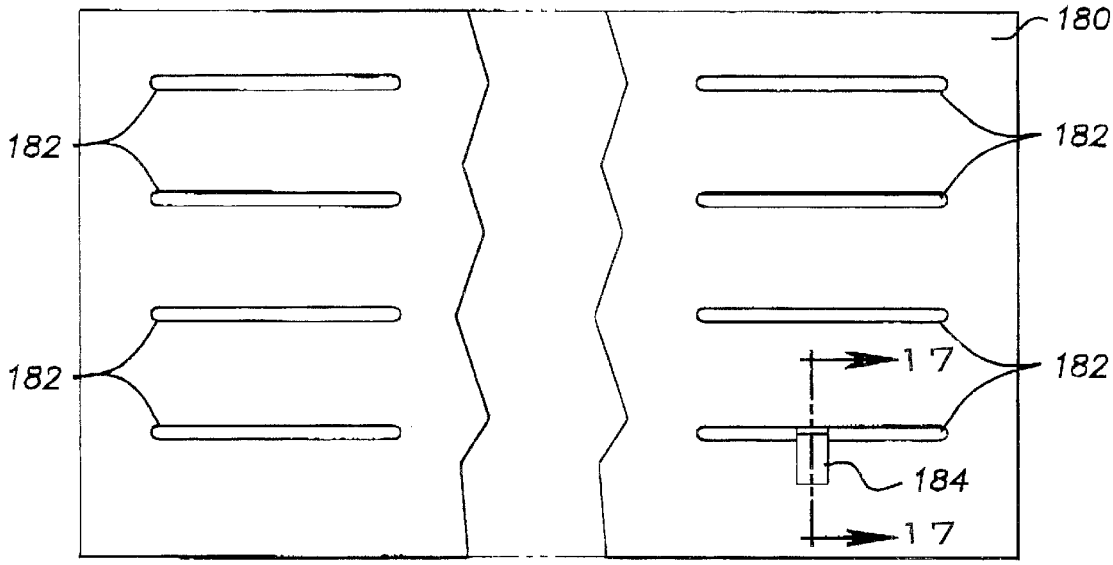
FIG. 16 is a front elevational view showing a display panel having a plurality of grooves and a bracket mounted in one of the grooves in accordance with another embodiment of the invention.

Referring to FIG. 16, a display panel 180 having grooves 182 for supporting hanger end portions 184 is shown. The display panel 180 may be a full-size wall panel (e.g. 4'×4' or 4'×8') or a smaller size counter-supported panel or self-standing modular panel (e.g. 2'×2').

The grooves 182 do not extend across the entire horizontal width of the panel, but rather, have shorter horizontal lengths and may be arranged in spaced arrays in the panel.

Figure 17:
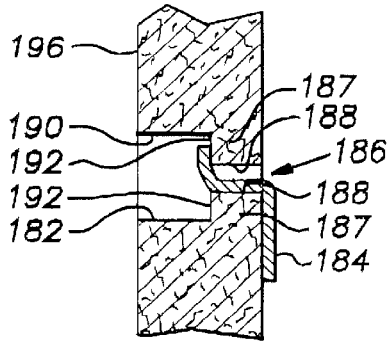
FIG. 17 is a fragmentary cross-sectional view, on an enlarged scale, taken along the line 17—17 in FIG. 16.

Referring to FIG. 17, each of the grooves 182 includes upper and lower overhang portions 187 forming a throat 186. The throat 186 is open to the front face of the panel and bounded by parallel opposed throat walls 188. A hanger end portion 184 is supported in the groove 182 in the same manner as in previously described embodiments. Similarly, although the throat walls 188 are shown in planes extending perpendicular to the front face of the panel, they may be inclined or sloped as in prior embodiments.

The groove 182 does not include a back or rear wall as most clearly shown in FIG. 16. Accordingly, the groove throat 186 opens into an inner recess 190. The recess 190 has an annular base 191 extending about the throat 186. The base 191 provides flat front or inner walls 192 for engaging the upper arm portion of the hanger end portion 184.

The groove 182 has dimensions similar to those of the groove 56 and the hanger end portion 184 has a shape similar to the hanger end portion 60. Accordingly, the display panel 180 is provided with a compact groove and hanger end portion construction and the improvements thereof as in previously described embodiments.

Figure 18:
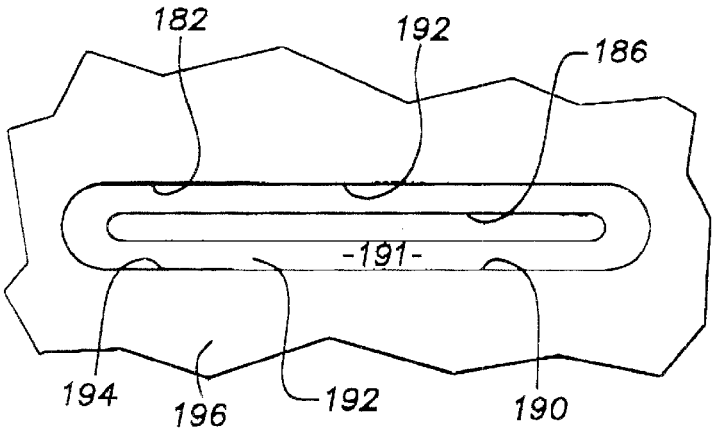
FIG. 18 is a fragmentary rear elevational view of the display panel of FIG. 16 showing the manner of forming a groove.

Referring to FIG. 18, the inner recess 190 comprises a cavity 194 formed in the rear face 196 of the panel 180. The cavity 194 may be formed by saw cutting and/or router milling techniques.

Figure 18A:
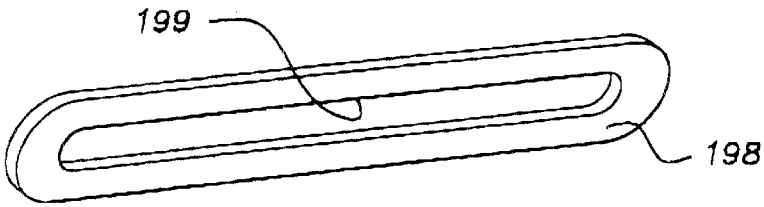
FIG. 18*a* is a perspective view, on an enlarged scale, showing an insert for reinforcing the groove of the embodiment of FIG. 16.

Referring to FIG. 18*a*, a reinforcing insert 198 is shown. The insert 198 may be mounted on the base 191 of the recess 190 to strengthen the groove 182. Insert 198 has an elongate annular shape sized to be coextensive with the base 191 and the inner walls 192, and includes a central opening 199 aligned with the throat 186. Insert 198 may be flat and have a thickness equal to about 1/16". The thickness of the overhang portions 187 may be reduced by an amount equal to the thickness of the insert 198 in order to maintain the original throat depth and hanger end portion offset.

The insert 198 may be formed of plastic, metal or other suitable material and include a decorative finish. Optionally, the insert 198 may include a projecting wall portion (not shown) overlying one or both of the throat walls 188.

Figure 19:
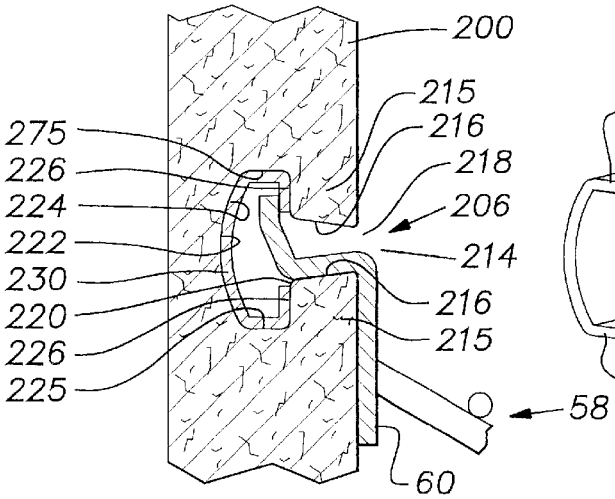
FIG. 19 is a fragmentary cross-sectional view showing a modified groove similar to that of the embodiment of FIG. 3 and having a C-shaped reinforcing insert mounted therein.

Referring to FIG. 19, a display panel 200 has a modified T-shaped slot or groove 206 with bracket 58 having its hanger end portion 60 mounted therein. The panel 200, similar to the panel 50, is bounded by a front face and a rear face, and a plurality of horizontally extending and vertically spaced grooves 206 are provided for supporting a plurality of brackets 58.

The groove 206 has upper and lower overhang portions 215 forming a throat 214 bounded by upper and lower throat walls 216 extending from a throat opening 218 to a throat inner end 220. The throat 214 joins an inner cavity or socket 222 at the throat inner end 220. The socket 222 is similar to the socket 72 and includes an arcuate rear wall 224 joining opposed top and bottom walls 225 that are connected to flat front or inner walls 226.

Figure 20:
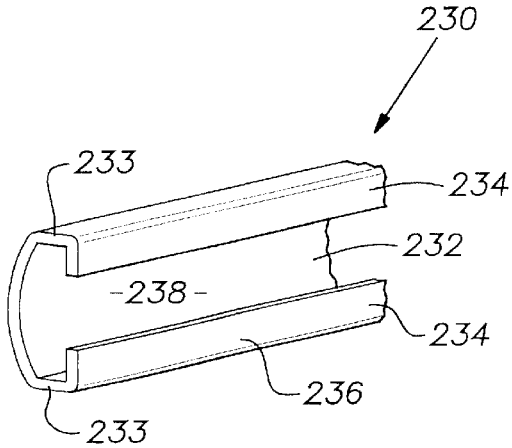
FIG. 20 is a fragmentary perspective view showing the C-shaped reinforcing insert of FIG. 19.

A C-shape insert 230 is mounted within the socket 222 for reinforcing the groove and increasing the hang weight prior to failure by distributing the resisting forces along the horizontal groove length. As best shown in FIG. 20, the insert 230 includes a semicircular wall portion 232 joining opposed top and bottom wall portions 233 connected to wall portions 234. The insert 230 has an outer surface 236 extending along the semicircular wall portion 232, top and bottom wall portions 233 and opposed wall portions 234. The outer surface 236 is in substantial contact engagement with the surfaces of the wall portions 224, 225 and 226 that form the socket 222.

The socket 222 is larger than the socket 72 by an amount equal to about the thickness of the insert 230. The inner surface 238 of the insert 230 has a shape and size corresponding with those of the socket 72. The throat walls 216 are shorter than the throat walls 66 by an amount equal to the thickness of the insert 230. Accordingly, the depth of the throat 214 including the thickness of the insert 230 is substantially equal to the depth of the throat 64. The width of the throat opening 218 is equal to the width of the throat opening 68. In this manner, the same hardware, such as the bracket 58, as used in connection with the prior embodiments may also be used in connection with the display panel 200 having an insert reinforced groove 206.

The insert 230 has a wall thickness equal to about 1/16" and it may be formed of any suitable material such as plastic or metal. For example, the insert may be formed by extrusion of polyethylene or polyvinyl chloride. Similarly, the insert may be formed as an aluminum extrusion. Such extrusion techniques are known in the art.

The insert 230 or its inner surface 238 may be finished or decorated with a color contrasting or matching the color of the front face of the display panel. Also, the outside surface 236 of the insert may be provided with a friction enhancing profile such as projecting ribs or recessed surface grooves.

The insert 230 may extend the entire horizontal length of the groove 206. If the insert is sufficiently flexible, it may be inserted through the throat opening 218 of the groove 206. If the insert is not sufficiently flexible, it may be inserted into the open end of the groove in the side edge of a display panel.

Figure 21:
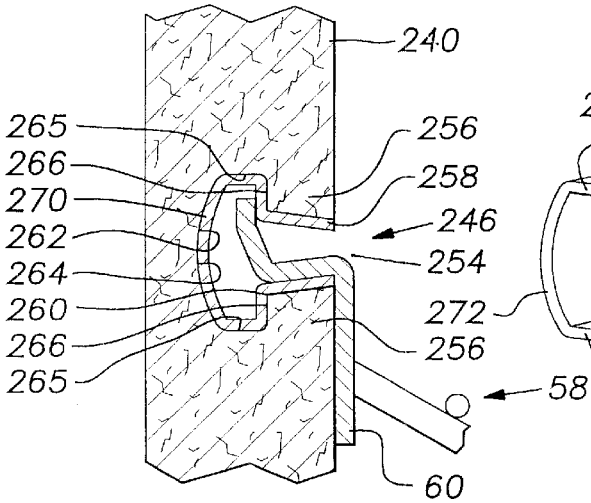
FIG. 21 is a fragmentary cross-sectional view showing a modified groove similar to that of the embodiment of FIG. 3 and having a modified C-shaped reinforcing insert mounted therein.
Figure 22:
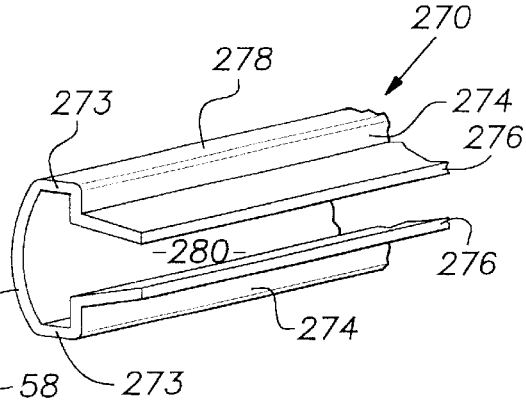
FIG. 22 is a fragmentary perspective view showing the modified C-shaped reinforcing insert of FIG. 21.

Referring to FIG. 21, a display panel 240 has a slot or groove 246 for mounting the bracket 58 by receipt of hanger end portion 60. The groove 246 has a throat 254 formed by upper and lower throat walls 256 extending from a throat opening 258 to a throat inner end 260. The throat 254 joins an inner cavity or socket 262. The socket 262 is similar to the socket 72 and includes an arcuate rear wall 264 joining opposed top and bottom wall portions 265 connected to wall portions 266.

A C-shape insert 270 is mounted within the socket 262. The insert 270 includes a semicircular wall portion 272, top and bottom wall portions 273, and opposed wall portions 274 that include laterally extending end or throat portions 276. The insert 270 has an outer surface 278 extending along wall portions 272, 273, 274 and 276. The outer surface 278 is in close contact engagement with the surfaces 264, 265 and 266 forming the socket 262 and with the throat walls 256.

The socket 262 is sized similar to the socket 222 described above. Also, the inner surface 280 of the insert 270 has a shape and size corresponding with those of the socket 72. The throat opening formed by the insert end or throat portions 276 will have a width less than that of the throat 64. However, the resulting groove opening defined by the inner surface 280 of the insert 270 is otherwise similar to that described above in respect to the embodiment shown in FIG. 3 and the same hardware may be used as illustrated by the mounting of the bracket 58.

The insert 270 may have a 1/16" wall thickness as in the case of the insert 230, and it may be formed using the same materials and processes. Also, it may be similarly mounted in the groove 246.

As compared with prior art panels, the display panels of the invention reliably support increased hang loads as indicated by increased maximum hang weight strengths. The maximum hang weight strength is defined as the maximum load supported by a cantilever bracket mounted in the panel groove for a three-day period of time without panel failure; the load being applied a selected distance from the panel face and being incrementally increased at fixed time periods, e.g. every three days. Failure is indicated by a full bracket pullout with rupture of the panel or a partial bracket pullout with the bracket being substantially displaced from its intended support position due to cracking or other structural failure of the panel.

The width of the hanger end portion should be similar for comparable tests since increased widths tend to increase the maximum hang weight strength. The support arm or shelf of the cantilever bracket may project in a perpendicular direction or an inclined direction from the panel face. Based upon experience to date, the perpendicular or inclined direction of the support arm or shelf does not significantly affect the hang weight strength. The torque moment applied by the bracket to the panel is directly related to the distance from the panel face at which the load is applied, and the maximum hang weight strength is reduced as the distance from the panel face to the load is increased.

The maximum hang weight strengths for prior art groove systems and for groove systems in accordance with the invention were tested and the results are reported in Table 1 below. The grooves were formed in similar medium density fiberboard panels at the indicated center-to-center distance. The panels were mounted to an interior structural wall, and the hang weight strength tests were performed at room temperature and humidity conditions.

TABLE 1

| TEST NO. | GROOVE SYSTEM | CENTER TO CENTER | BRACKET SUPPORT AND SPACING[1] | | MAX. HANG WEIGHT STRENGTH[2] LBS. |
|---|---|---|---|---|---|
| 1 | FIG. 1 | 3" | inclined | 9.5" | 34.7 |
| 2 | FIG. 3 | 2" | inclined | 9.5" | 42.6 |
| 3 | FIG. 3 | 2" | straight | 12" | 42.5 |
| 4 | FIG. 3 | 3" | inclined | 9.5" | 51.7 |
| 5 | FIG. 3 | 3" | straight | 6" | 75.0 |
| 6 | FIG. 3 | 3" | straight | 12" | 53.3 |
| 7 | FIG. 3 | 4" | inclined | 9.5" | 50.0 |
| 8 | FIG. 19[3] | 6" | inclined | 9.5" | 85.0 |
| 9 | FIG. 19[3] | 6" | straight | 6.0" | 75.0 |

[1]Brackets for FIG. 1 had a reinforced 3" wide backplate engaging panel face, all other brackets had 2" wide backplate. Incline is 60° and spacing is distance from load hang point to face of panel.
[2]FIG. 1 tests begin with 23 lb. load for 3 days, and then increase by 3 lbs. every 3 days until failure by panel fracture and bracket pullout. All other tests start at 25 lbs. and increase by 5 lbs. every 3 days.
[3]Groove of FIG. 3 having a full length C-shape aluminum insert as shown in FIGs. 19 and 20.

Referring to Table 1, test conditions considered to closely predict retail sales applications of the display panels include a three inch center to center spacing for the groove and an inclined bracket with the load being supported at 9.5 inches from the panel face. At these conditions, Test No. 1 shows that the prior art groove of FIG. 1 has a maximum hang weight strength of about 34.7 lbs. In comparison, Test No. 4 shows that the groove of FIG. 3 fitted with a corresponding bracket having a compact hanger end portion has a maximum hang weight strength of 51.7 lbs.

Table 1 also confirms the achievement of satisfactory hang weight strength with a 2 inch center to center groove spacing. As reported in Test No. 2, testing of a corresponding inclined bracket resulted in a maximum hang weight strength of 42.6 lbs. In comparison, the prior art groove of FIG. 1 at a 2 inch center to center spacing has resulted in hang weight strength reductions in the order of 30 to 40 percent and a maximum hang weight strength in the range of 20.8 to 24.3 lbs. This hang weight is too low to provide an acceptable product for retail sales applications.

Presently, center to center spacings greater than three inches have not been found to provide further increases in hang weight strength. For example, compare test results in Test Nos. 3 and 4.

The use of C-shape aluminum inserts as shown in FIG. 19, having a nominal thickness of about 1/16 inch provide substantially increased hang weight strengths. As shown by Test No. 8, hang weight strengths of 85 pounds have been achieved with an inclined bracket and a 9.5 inch load spacing from the panel face.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed:

1. A display board comprising a panel having a front face and a back face, said front face including horizontally extending and vertically spaced grooves to allow the installation of a hanger end portion of a cantilever bracket for support of articles, said horizontally extending grooves each having a throat open to said front face and including opposed throat walls extending toward said back face to a throat inner end, said throat inner end joining to a socket having a bulbous cross-sectional shape configured to accept said hanger end portion of said cantilever bracket, said socket including a curved back wall connected to spaced planar inner walls that join said throat walls on opposite sides of said throat.

2. A display board as in claim 1, wherein one of said throat walls is contained in a throat wall plane that intersects a plane containing said front face at an included angle between from about 77.5 degrees to about 90 degrees.

3. A display board as in claim 2, wherein said included angle is between 82 degrees and 88 degrees.

4. A display board as in claim 1, wherein one of said throat walls is contained in a throat wall plane that intersects a plane containing said front face at an included acute angle between from about 77.5 to about 88 degrees.

5. A display board as in claim 1, wherein each of said throat walls is contained in a throat wall plane that intersects a plane containing said front face at an included acute angle, said groove includes a groove overhang portion on each side of said throat, said overhang portions having a thickness extending from said front face to said inner walls and having beveled ends forming said throat walls.

6. A display board as in claim 5, wherein said socket has a cross-section symmetrical about one axis.

7. A display board as in claim 6, wherein said throat has a maximum width at said front face equal to less than 0.375"

and said groove has a width, a depth and a width to depth aspect ratio in the range of from about 1 to about 1.75.

8. A display board as in claim 6, wherein said curved back wall has a semicircular cross-section that joins extremities of said inner walls and said inner walls extend diametrically toward said throat walls.

9. A display board as in claim 8, wherein an insert is mounted within said groove, said insert including an outer wall having a C-shape cross-section including a semicircular portion connecting opposed diametrical portions, said insert outer wall being in substantial contact engagement with groove surfaces along a horizontal extent of said groove, said insert semicircular portion engaging said semicircular cross-section of said socket and said insert diametrical portions engaging said inner walls.

10. A display board as in claim 9, wherein said insert is formed of metal or plastic and reinforces said panel.

11. A display board as in claim 8, wherein an insert is mounted within said groove, said insert including an outer wall having a C-shape cross-section including a semicircular portion connecting opposed diametrical portions and laterally intersecting end portions, said insert outer wall being in substantial contact engagement with groove surfaces along a horizontal extent of said groove, said insert semicircular portion engaging said semicircular cross-section of said socket, said insert end portions engaging said inner walls and said insert end portions engaging said throat walls.

12. A display board as in claim 11, wherein said insert is formed of metal or plastic.

13. A display board as in claim 1, wherein each of said grooves has a throat width at said front face equal to less than 0.375", a groove width less than 1.25" and a throat depth greater than about 0.3".

14. A display board as in claim 13, wherein said panel is formed of a medium density fibreboard and said grooves have a center to center spacing equal to about 2".

15. A display board as in claim 1, wherein said throat has a throat depth extending from said throat opening to said throat inner end, said throat depth is greater than 0.3" and said groove has a cross-section symmetrical about one axis, and a width to depth aspect ratio in the range from about 1 to about 1.75.

16. A display board as in claim 15, wherein said throat depth is about 0.3" and said groove width to depth aspect ratio is about 1.

17. A display board in combination with a cantilever bracket for support of articles, said bracket comprising a hanger end portion including a central portion having a length extending laterally between an upper arm portion and a lower arm portion, said panel having a front face including horizontally extending and vertically spaced grooves to mount said hanger end portion, said horizontally extending grooves each including opposed overhang portions forming a throat open to said front face, said overhang portions having end walls forming opposed throat walls extending to a throat inner end, at least one of said throat walls being contained in a plane inclined at an included acute angle with respect to a plane containing said front face, said throat inner end joining to a socket configured to accept said hanger end of said cantilever bracket, said socket including a curved back wall and at least one inner wall remote of said at least one throat wall, upon installation of said hanger end portion in said groove to support said bracket, said lower arm portion engaging said front face in response to bracket loads, said at least one inner wall engaging said upper arm portion with compressive forces resisting said bracket loads and said central portion being supported along its length by said at least one throat wall to transfer compressive forces from said at least one inner wall to said overhang portion adjacent said at least one throat wall.

18. A display board as in claim 17, wherein said overhang portion has a thickness extending from said front face to said inner wall.

19. A display board as in claim 18, wherein said overhang portion has a thickness equal to about 0.3" or more, said groove has a cross-section symmetrical about one axis, a width and a depth, and a groove width to depth aspect ratio in the range of from about 1 to about 1.75.

20. A display board as in claim 19, wherein said throat has a throat width in said front face equal to less than ⅜".

21. A display board as in claim 17, wherein said groove has a compact configuration with said curved back wall of said socket being shaped to correspond with the pivotal sweep of said upper arm portion extremities, with minimal clearance, as said upper arm portion is inserted into said groove and pivoted into engagement with said at least one inner wall during installation.

22. A display panel in combination with a cantilever bracket for support of articles, said bracket including a compact hanger end portion for mounting said bracket to said panel, said compact hanger end portion having a generally s-shape profile including a central portion connecting an upper arm portion and a lower arm portion, said display panel having a front face and a back face, said front face having horizontally extending and vertically spaced grooves constructed to allow the installation of said compact hanger end portion of said bracket, said horizontally extending grooves each having a throat open to said front face and at least one throat wall extending toward said back face to a throat inner end, said throat inner end joining to a socket including a curved back wall opposite said throat inner end and at least one inner wall, said upper arm portion being configured to be received in said socket in engagement with said at least one inner wall with said central portion being supported along substantially all of its length by said at least one throat wall.

23. A combination as in claim 22, wherein said at least one throat wall is contained in a throat wall plane that intersects a plane containing said front face at an angle between 77.5 degrees and 90 degrees and said central portion extends to said lower arm portion at a corresponding included angle.

24. A combination as in claim 23, wherein said angle is in the range of from about 82 degrees to about 88 degrees.

25. A combination as in claim 22, wherein said compact hanger end portion is formed by reshaping a standardized hanger end portion also having a generally s-shaped profile including a relatively longer upper arm portion and a relatively shorter central portion as compared with said compact hanger end portion.

26. A combination as in claim 22, wherein said upper arm portion extends upwardly from said throat wall at an angle inclined away from said front face and into engagement with said inner wall.

27. A display board comprising a panel having a front face including horizontally extending and vertically spaced grooves for installation of a hanger end portion of a cantilever bracket for support of articles, said horizontally extending grooves each having a throat open to said front face, said throat including first and second throat walls extending from said front face along a throat depth to a throat inner end, said throat inner end joining to a socket, said socket having a bulbous shape and including first and second planar front walls each having a length extending away from said throat inner end in opposite directions, said throat depth being at least equal to said front wall length and said first and second throat walls being contained in a throat wall plane that intersects a plane containing said front face at an angle between 77.5 degrees and 90 degrees.

28. A display board as in claim 27, wherein said grooves have a center-to-center spacing equal to about 2".

29. A display board as in claim 28, wherein said front walls are generally parallel to said front face and join said throat walls on opposite sides of said throat.

30. A display board as in claim 29, wherein said groove has a cross-section symmetrical about one axis and a width to depth aspect ratio in the range of from about 1 to about 1.75.

31. A display board as in claim 30, wherein said socket has a curved back wall.

32. A display board as in claim 31, wherein said socket has a semicircular cross-section with said front walls extending diametrically toward said throat walls and said curved back wall joins extremities of said front walls.

33. A display board as in claim 32, wherein an insert is mounted within said groove, said insert including an outer wall having a C-shape cross-section including a semicircular portion connecting opposed diametrical portions, said insert outer wall being in substantial contact engagement with groove surfaces along a horizontal extent of said groove, said insert semicircular portion engaging said semicircular cross-section of said socket and said insert diametrical portions engaging said front walls.

34. A display board as in claim 32, wherein an insert is mounted within said groove, said insert including an outer wall having a C-shape cross-section including a semicircular portion connecting opposed diametrical portions and laterally intersecting end portions, said insert outer wall being in substantial contact engagement with groove surfaces along a horizontal extent of said groove, said insert semicircular portion engaging said semicircular cross-section of said socket, said insert end portions engaging said front walls and said insert end portions engaging said throat walls.

35. A display board as in claim 27, wherein said throat depth is equal to about 0.3" or more.

36. A display board as in claim 35, wherein said throat has a throat width in said front face equal to less than ⅜".

37. A display board in combination with a cantilever bracket for support of articles, said bracket including a hanger end portion for mounting the bracket to said board, said hanger end portion having a central portion extending between upper and lower arm portions, said display board comprising a panel having a front face including horizontally extending and vertically spaced grooves constructed to allow the installation of said hanger end of said bracket, said horizontally extending grooves each having a throat including a throat opening in said front face and opposed throat walls extending along a throat depth to a throat inner end, at least one of said throat walls being contained in a plane inclined at an included acute angle with respect to a plane containing said front face, said throat inner end joining to a socket having a curved back wall extending to at least one inner wall remote of said at least one throat wall, upon installation of said hanger end portion in said groove to support said bracket, said lower arm portion engaging said front face in response to bracket loads, said upper arm portion imposing bracket load forces on said at least one inner wall and said central portion being supported along its length by said at least one throat wall to transfer bracket load forces from said at least one inner wall to said at least one throat wall, said groove having a compact configuration with said curved back wall of said socket being shaped to correspond with the pivotal sweep of said upper arm portion extremities, with minimal clearance, as said upper arm portion is inserted into said groove and pivoted into engagement with said at least one inner wall during installation.

38. A combination as in claim 37, wherein said included acute angle is in the range of from about 77.5 degrees to about 88 degrees and said central portion extends between said upper and lower arm portions at a corresponding angle.

39. A combination as in claim 38, wherein said socket has a bulbous shape including said at least one inner wall and a second inner wall, each of said inner walls extending away from said throat inner end in opposite directions and being connected to said curved back wall.

40. A combination as in claim 39, wherein said inner walls are generally parallel to said front face and join said throat walls on opposite sides of said throat.

41. A combination as in claim 37, wherein said at least one throat wall is contained in a throat wall plane that intersects a plane containing said front face at an angle between 77.5 degrees and 90 degrees and said central portion extends to said lower arm portion at a corresponding included angle.

42. A combination as in claim 37, wherein said throat includes a second throat wall extending along said throat depth to said throat inner end, said socket has a bulbous shape including said at least one inner wall and a second inner wall, each of said inner walls extending away from said throat inner end in opposite directions and being connected to said curved back wall.

43. A combination as in claim 42, wherein said groove has a width and a depth, and a width to depth aspect ratio in the range of from about 1 to about 1.75.

44. A combination as in claim 43, wherein said throat has a throat width in said front face equal to less than ⅜".

45. A combination as in claim 44, wherein said grooves have a center-to-center spacing equal to about 2".

46. A combination as in claim 37, wherein said angle is in the range of from about 82 degrees to about 88 degrees.

* * * * *

UNITED STATES PATENT AND TRADEMARK OFFICE

CERTIFICATE OF CORRECTION

PATENT NO. : 6,772,890 B2
APPLICATION NO. : 10/114791
DATED : August 10, 2004
INVENTOR(S) : Rodney S. Campbell et al.

It is certified that error appears in the above-identified patent and that said Letters Patent is hereby corrected as shown below:

On the Title page, Item (56) References Cited, the following references are to be included:

U.S. Patents:

--6,363,645 4/2/2002 Hunter--.

Foreign Patents:

--WO 00/47088 A1 8/17/2000 Holmstedt--.

Signed and Sealed this

First Day of September, 2009

David J. Kappos

David J. Kappos
*Director of the United States Patent and Trademark Office*